United States Patent [19]

Wolfe

[11] Patent Number: 4,543,982

[45] Date of Patent: Oct. 1, 1985

[54] AUTOMATIC REWINDING WATER HOSE REEL

[76] Inventor: Eddie B. Wolfe, Rte. 14, Box 200, Greenville, Tenn. 37743

[21] Appl. No.: 572,065

[22] Filed: Jan. 19, 1984

[51] Int. Cl.[4] ..... B65H 75/34

[52] U.S. Cl. ..... 137/355.2; 137/355.23; 137/355.26; 74/577 S; 185/39; 242/86

[58] Field of Search ..... 137/355.16, 355.2, 355.21, 137/355.23, 355.26; 242/86; 74/577 S; 185/39

[56] References Cited

U.S. PATENT DOCUMENTS

| | | | |
|---|---|---|---|
| 2,496,489 | 2/1950 | Palm | 137/355.2 |
| 3,388,716 | 6/1968 | Wilson | 137/355.22 |
| 3,939,862 | 2/1976 | Booth | 137/355.16 |
| 4,306,688 | 12/1981 | Hechler, IV | 242/86 |

*Primary Examiner*—Martin P. Schwadron

*Assistant Examiner*—Sheri Novack

*Attorney, Agent, or Firm*—Leonard Bloom

[57] ABSTRACT

A hose reel assembly including a housing of substantially cylindrical shaped configuration, a water inlet area axially disposed relative to the longitudinally axis of the cylinder, a transfer hose to allow communication of a fluid inlet to the hose disposed upon an associated reel contained within the housing, a spring associated between a stationary portion of a reel support spindle and the hose reel to resist rotation and paying out of the hose, a pawl and ratchet mechanism intermittantly engageable along a certain periphery of the ratchet to selectively enable and disable the ratchet mechanism against the spring, and a squeegie mechanism associated with an outlet of the hose which allows removal of water within the hose upon retraction of the hose within the housing in the absence of fluidic pressure.

6 Claims, 5 Drawing Figures

AUTOMATIC REWINDING WATER HOSE REEL

BACKGROUND OF THE INVENTION

The following invention relates generally to devices for storing and reeling garden hoses, particularly hoses of the type which are flat in the absence of fluidic pressure. More particularly, a hose reel instrumentality is provided which allows utilization of the hose when all or a portion of the hose has been paid out from the storage reel, and when the hose is to be stored after use, the water is automatically forced out of the hose and automatically rewound on an associated supporting drum of the hose reel.

For yard maintenance, irrigation and watering of the yard by means of a hose has been a longstanding solution to the problem of facile liquid deployment to area remote from the water source. However, the usage of watering hoses to solve the irrigation problem has provided a problem in and of itself, to wit: the storage and transport of the hose before, during and after use. When using the hose with a lawn sprinkler for example, it is common practice to leave the hose in its last position after the irrigation has been completed, and the hose therefor may tend to be obscured by the grass and terrain associated therewith, serving as an impediment to foot traffic and providing exposed hose portions which can be damaged by the passage of yard and garden implements such as lawnmowers, tillers, and the like.

While various devices have been created in the past to facilitate the rapid storage of such garden hoses, none have provided total response to the needs of the user for any of a plurality of reasons and none therefor have gained acceptance in the market place; thus, a longstanding yet heretofor unsatisfied need still exists for the apparatus according to the instant application as disclosed herein.

The following citations reflect the state of the art of which applicant is aware insofar as these citations appear to be germane to the process at hand. U.S. Pat. Nos. 1,441,572, France; 2,629,630, Roark; 2,887,121, Magee; 2,907,534, Benstein; 3,388,716, Wilson; 3,715,526, Blanch et al; 4,206,688, Hechler, IV.

The patent to Hechler, IV reflects the most recent prior art attempt to address the longstanding need for hose reel assemblies and includes a hose having one end 31 centrally disposed on the reel for coupling to a source of water and an internal hub section 36 adapted to receive wraps of the hose thereupon. An outlet 18 allows another end 24 of the hose to be unwrapped from the hub 36 and an intermitently operated squeegie unit 18 cooperates with the hose end 24 for removal and insertion therebetween so as to remove water from the hose when being reeled back on to the hub. The reel operation is manual and occurs through the rotation of the handle 22. It is required that in use, the Heckler device must be completely unwound.

Roark teaches the use of an oxygen acetylene hose reel including a spring associated with a drum upon which the hose is wrapped to become tensioned as the hose is paid out, the spring working against a ratchet member sensitive to centrifugal force for engagement. The structure is specifically designed for non-compressible solid hose and accordingly the associated complex network pipe fittings makes the device substantially more complicated than the instant application.

Benstein teaches the use of an overhead hose reel which includes first and second rollers (FIG. 3) to facilitate the deployment of the hose without undue friction and abrasion being mamnifested upon the hoses.

France teaches the use of another form of pawl and ratchet mechanisms and the remaining citations show the state of the art further.

By way of contrast, the instant application is distinguished over the known prior art by the provision of a hose reel assembly including a drum adapted to receive a plurality of hose wraps thereon, the hose being formed from material which can be stored in a flat condition, the drum assembly capable of receiving a substantial amount of hose thereon, greater than the prior art, and adequate clearance being provided so that when only a portion of hose is unreeled from the mechanism the device will still allow the hose to be operatively used. In addition, a centrally disposed swivel allows communication of fluid from a water spigot or the like to the hose contained on the drum by means of a radially extending flexible hose section translating thereafter into a longitudinally extending hose section disposed along an outer periphery of the hose supporting drum capable of passing fluid therethrough to the hose that is to be deployed. A novel ratchet and pawl mechanism is associated with the instant application which works against spring tensioning of the drum so that the facile deployment and retraction of the hose can be effected without excessive forces being imposed on the hose itself. A novel support spindle for the drum is disclosed which includes a stationary segment and a rotating segment which carries the drum thereon, appropriate bearings extending between the stationary and rotating segments of the axle and further additional bearings being provided along relatively moving surfaces for the minimization of friction. The outlet of the hose reel where a hose end is disposed includes a squeegie mechanism which removes water from within the hose prior to storage so that the device may be kept in cold climates outdoors without the worry of having the hose burst due to expansion of the water when freezing. The squeegie mechanism includes a resilient damping instrumentality calibrated to be overridden by fluid is flow pressure common to most water systems, but in the absence of ambient water pressure, the squeegie device is enabled. The housing associated with the reel is non-light transmissive to retard the effects of ultraviolet raidation upon the hose which can cause rotting and decaying, and a suitable removeable support member and handle are provided for ease in transport and deployment for use.

OBJECTS AND SUMMARY OF THE INVENTION

Accordingly, this invention has as its objective the provision of a new and novel hose reel assembly.

More particularly, this invention has as its objective the provision of a new and novel hose assembly as characterized hereinabove which includes an improved squeegie biasing means which is sensitive to the fluidic pressure contained within the hose so that in the absence of the fluidic pressure, the squeegie biasing means is enabled.

It is yet a further object of this invention to provide a device as characterized above which allows for rotation of the drum upon which the hose is disposed whereby twisting and therefor damaging of the hose is prevented.

It is yet a further object of this invention to provide a device as characterized above in which a split shaft is associated with the support drum hub upon which the hose is disposed so that relative rotation of first and second major components of the hose reel assembly can be effected for the attributes set forth immediately hereinabove.

It is yet a further object of this invention to provide a device as characterized above in which the expansible flat hose includes an end portion connected to the source of water in such a manner that the hose can be utilized without the entire length thereof being paid out.

It is yet a further object of this invention to provide a device as characterized above which allows automatic retraction of the hose when not in use.

It is yet a further object of this invention to provide a device as characterized above which is relatively inexpensive to manufacture, lends itself to mass production techniques and is durable in construction.

It is yet a further object of this invention to provide a device as characterized above which enhances the life of the hose associated therewith by shielding same from the deleterious effect of the sun's ultraviolet radiation and lessening the hose's exposure to the damage associated with its contact by lawn and garden implements. Moreover, the tidy storage of the device as set forth hereinafter lends itself to redeployment of the hose remote from the initial site and avoids the hose becoming an impediment to passersby.

These and other objects will be made manifest when considering the following detailed specification when taken in conjunction with the appended drawing figures wherein there has been provided a hose reel assembly including a housing within which is disposed a drum having a plurality of hose wraps looped thereover, an instrumentality for allowing rotation of the drum and its associated hose without twisting of the hose and means for admitting fluid therethrough, an instrumentality for the effective deployment of the hose to an area remote therefrom assisted by a retaining ratchet which is effectively abled or disabled by the appropriate configuration of the ratchet mechanism, the ratchet operating against a spring instrumentality for the automatic retraction of the hose within the housing when not in use, a biased squeegie member enabled by the absence of fluidic pressure within the hose whereby liquid within the hose is removed during the hose retraction process so that the hose may be left in hostile environments particularly in winter without damage to the hose, the hose is shielded from the ultraviolet rays of the sun and is protected from implements or providing an impediment to passersby.

BRIEF DESCRIPTION OF THE PREFERRED EMBODIMENT

Figure 1:
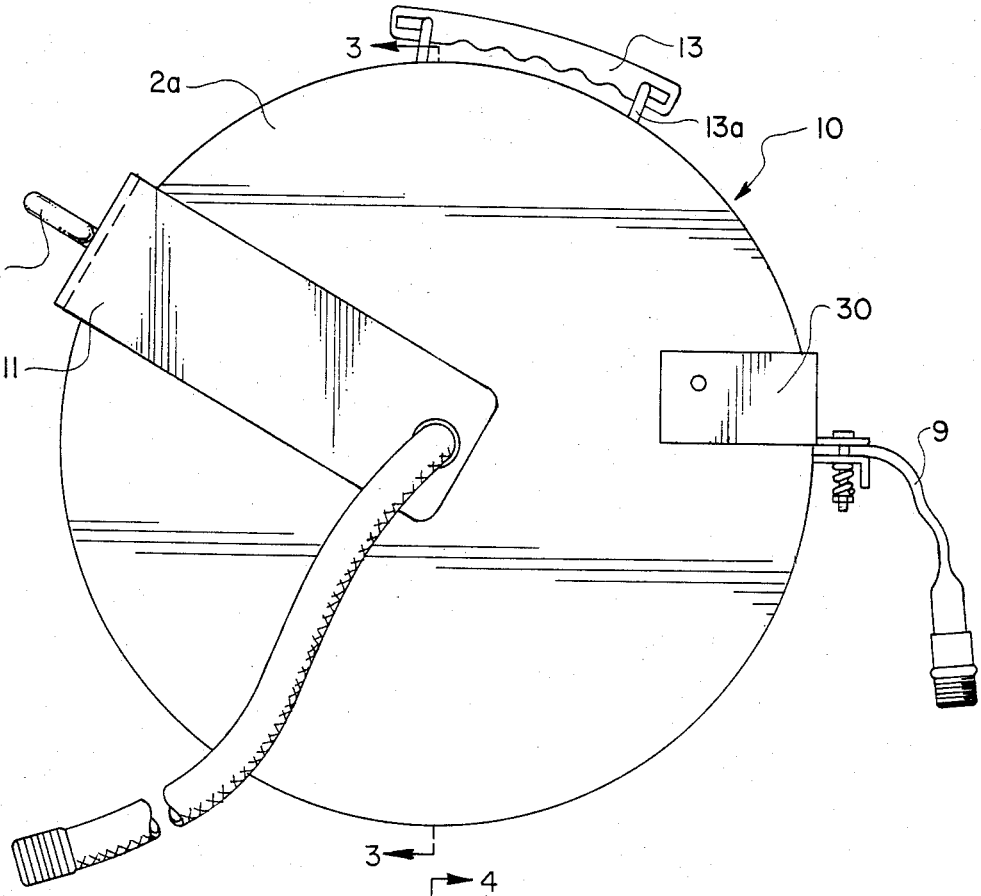
FIG. 1 is a side view of the apparatus according to the present invention.

Referring to the drawings now, wherein like reference numerals refer to like parts throughout the various drawing figures, reference numeral 10 is directed to the housing reel assembly according to the present invention.

As shown in the drawing figures, the housing reel assembly 10 is formed as a housing 1 having an interior 4 defined by a pair of first and second spaced circular sidewalls 2, the sidewalls having a side which includes the hose feed area 2*a* and a side 2*b* near which the ratchet is disposed. The interior 4 is contained and defined by an annular arcuate end wall 3 circumscribing the outer periphery of the sidewalls 2 so that the entire housing is of substantially hollow cylindrical shaped configuration.

Figure 3:
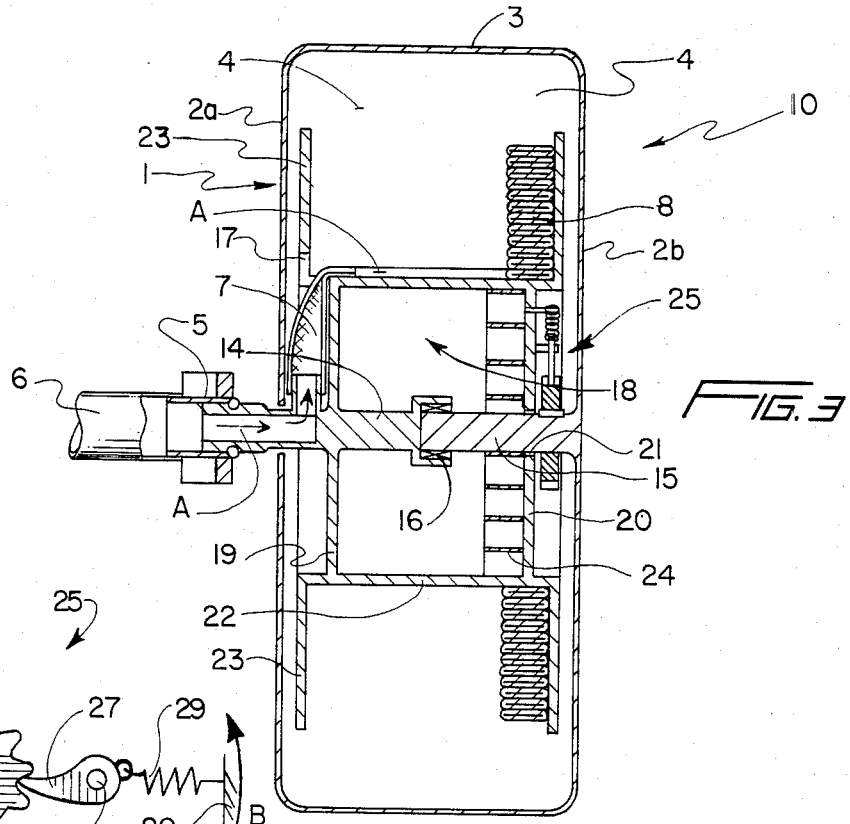
FIG. 3 is a sectional view taken along lines 3—3 of FIG. 1.

The hose feed side 2*a* of the housing 1 includes a means for receiving the fluid from a conventional water spigot or tap and provides a hose inlet 6 communicating with the interior 4 of the housing by means of a combined swivel and threaded fastener 5, the swivel portion 5*b* allowing 360° rotation of the inlet hose 6 relative to a threaded stem end 5*a* in a releasably threaded fastening manner. The hose inlet 6 communicates through the swivel and threaded end 5 to stacked hose 8 by means of a transfer hose 7, which as shown in FIG. 3 includes an axially extending passage and a radially extending portion, the radially extending portion communicating in turn with a transfer hose portion extending in a longitudinal direction on an outer face of a hose support surface 22 as will now be defined. Thus, incoming fluid through the inlet hose 6 is communicated to the stacked hose 8 via the transfer hose 7 and allows the stacked hose 8 to be filled with liquid. In turn the stacked hose 8 communicates with the outlet hose 9 for fluid communication with the environment. As shown in the drawing, the transfer hose allows a fluid path as denoted by the arrows A in FIG. 3.

Figure 4:
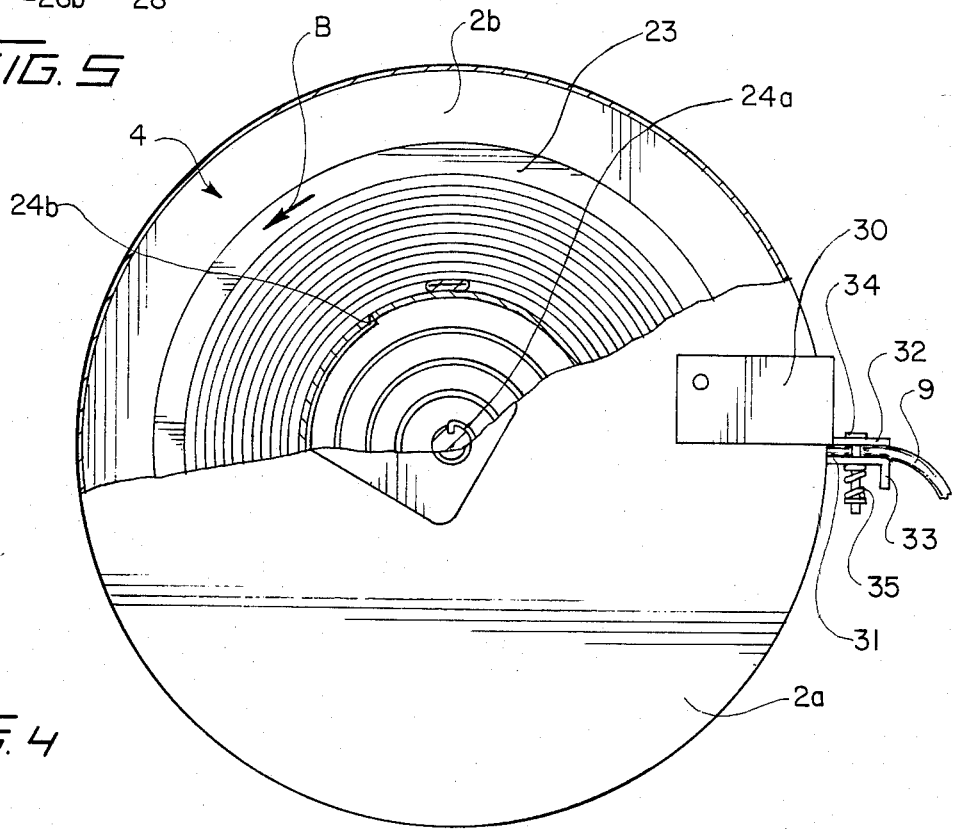
FIG. 4 is a partial sectional view taken along lines 4—4 of FIG. 2.

As stated, the inlet hose 6 is axially oriented with the housing 1 and a central core of the housing includes a rotating axle carried upon a bearing 16 and supported by a stationary axle 15 formed integrally with the ratchet side wall 2*b*, the stationary axle 15 extending radially inward within the housing interior 4. Thus, rotation of the axle 14 relative to the axle 15 is possible. The rotating axle 14 communicates with radially extending web members 20 which serve to support the hose drum support surface 22, the hose drum support surface 22 having in turn upwardly extending hose support sidewalls 23 which together with the hose drum support surface 22 form a U-shaped section. An additional web 20 extends down to and communicates adjacent the stationary axle 15 by means of a further bearing 21 so that rotation of the hose drum support surface and sidewalls can occur independent of the stationary axle 15 and therefor the outer housing 1. A passageway 17 is provided along the intersection of one of the upwardly extending hose support side walls 23 and its associated hose drum support surface 22 to allow passage of the transfer hose 7 therebetween to allow fluid communication therebeyond. A face of the web 20 remote from the ratchet sidewall 2*b* has placed adjacent thereagainst a spring 24 which serves to rewind the hose upon its associated surface in a manner to be defined. More particularly, the rewind spring 24 has a first end 24*a* fastened to the fixed axle 15 and another end 24*b* fastens to an underside of the hose support surface 22 so that rotation of the hose support surface 22 in the direction of the arrow B (FIG. 4) is opposed by the spring 24.

Figure 5:
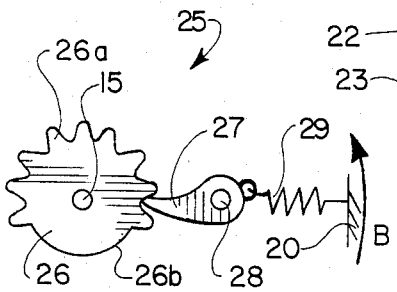
FIG. 5 is a side view of the ratchet mechanism.

To obviate the need for providing continuous tension on the hose against the pressure of the spring 24, a ratchet mechanism 25 is included and is disposed upon an opposed face of the web 20 immediately proximate the ratchet side wall 2*b* and is defined in FIG. 5. More particularly, the ratchet mechanism 25 includes a ratchet wheel 26 disposed upon the stationary axle 15 and keyed thereto so that rotation of the web 20 occurs independently of the ratchet wheel 26. The ratchet wheel 26 includes a plurality of teeth 26*a* circumscribing a major periphery of same but also includes a void 26*b* absent of teeth for purposes to be assigned shortly. A pawl 27 is pivoted and connected with the web 20 by means of pivot pin 28 and the pawl is biased against the ratchet teeth 26*a* by means of a spring 29 extending between the web 20 and an upwardly extending protrusion of the pawl 27. Thus, the spring 29 provides a force which in combination with the interengagement of the pawl 27 and the ratchet teeth 26 retard the effect of the return spring 24 until the hose causes advancement of the ratchet wheel 26 to a point where the void 26*b* occurs. At that point, the pawl 27 is effectively disabled, and the force of the spring 24 (when the hose is allowed to respond to the spring tension) allows the pawl 27 and its associated intermittant connection with the ratchet wheel teeth 26*a* to be overridden so that the hose can be retracted upon the drum defined by the hose support surfaces. In this manner, the pawl and ratchet mechanism provide an indexing means which are selectively engageable during certain arcuate portions of their engagement and accordingly, the hose can be retained in a deployed condition but can be rapidly retracted.

Figure 2:
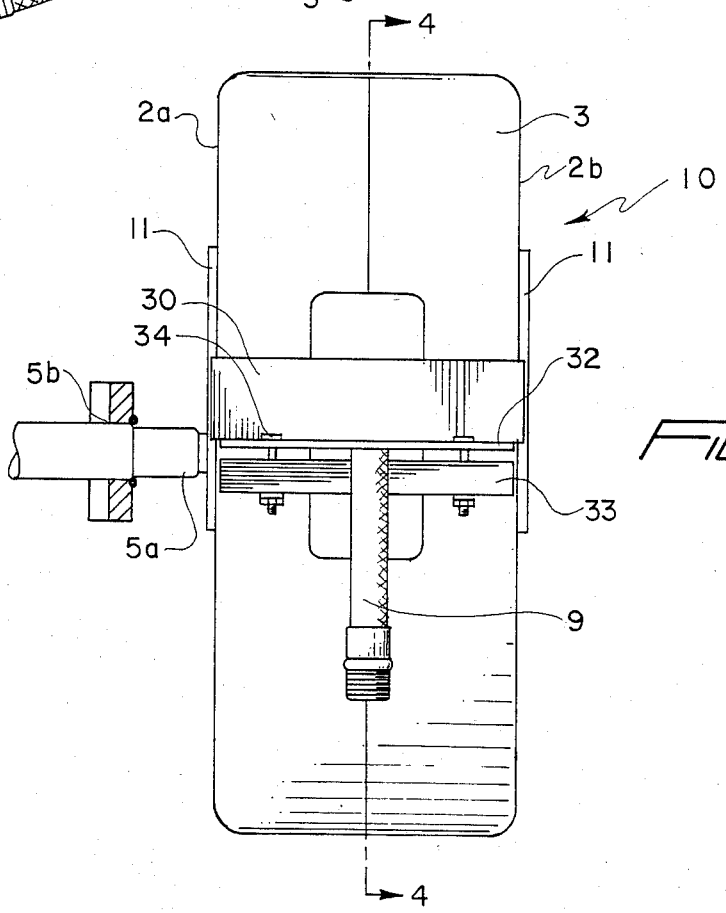
FIG. 2 is an end view of that which is shown in FIG. 1 from the right hand side thereof.

As shown in FIGS. 1 and 2, a means is provided to effectively educe the water from the hose upon rewinding same upon the drum, and includes a substantially U-shaped wiper bracket 30 formed with an overlying wiper extending from one edge thereof, the wiper bracket having two legs and a bite portion which supports the overlying wiper 32, the legs being fastened to opposed sidewalls of the housing, and the overlying wiper 32 fastened to a depending wiper 31 in a manner now to be defined. More particularly, the depending wiper 31 is of substantially L-shaped section having one leg parallel to the overlying wiper, and the other leg defining a guide lip 33 so that when the hose end 9 is depending as shown in FIGS. 1 and 2, minimal abrasion can occur. Note that the overlying wiper 32 has a bevelled edge for similar purposes. The overlying and depending wiper 31, 32 are both interconnected by means of vertically extending rods and nuts which serve to bias the wipers one relative to another, the spring tension of the biasing spring 35 selected to be compressed by the fluidic pressure adapted to be passed through the hose 9. Thus, the tension of the biasing spring within certain limits can be adjusted so that when in the absence of fluidic pressure, the squeegie effect of the overlying and depending wipers can be enabled.

A means for supporting the housing is also disclosed and includes a U-shaped mounting bracket 11 having first and second legs and a bite portion straddling the housing on opposed sidewalls thereof and the legs extending to the longitudinal axis of the housing, the bite portion serving to support a mounting eyelet 12 for removal disposition over a hook (not shown).

In addition, a handle 13 having first and second brackets 13*a* are included to transport the hose reel assembly as is desired.

In use and operation, an appropriate amount of hose is paid out from the housing and is held there by means of the ratchet's appropriate interconnection with the pawl 27; a source of water is allowed to communicate with the hose inlet 6 so that fluid can pass through the hose, overcome the squeegie assembly's spring tension and provide the appropriate irrigation. When need for the water has been met, a gentle tug on the hose coupled with turning off the water allows the hose to be retracted back into the housing with the squeegie mechanism operatively enabled. It is to be noted that there is adequate clearance on the drum defined by the hose support surface and side walls to accommodate the hose in either an emptied stored condition for example as in the wintertime, or with the hose filled with water if that should be so desired.

Having thus described the preferred embodiment of the invention, it should be understood that numerous structural modifications and adaptations may be resorted to without departing from the spirit of the invention.

What is claimed is:

1. A hose reel assembly comprising in combination:

a housing having an interior adapted to receive therein a plurality of hose wraps looped over a central supporting drum, inlet means to provide fluid communication between a source of water and the hose disposed thereon, a hose outlet extending through an opening within the housing, squeegie means sensitive to fluidic pressure of the water system whereby in the absence of fluidic pressure said squeegie means is enabled so that when the hose is retracted back into said housing water is purged from the hose, said squeegie means being assisted in purging by means of a spring biasing between said hose supporting drum and a stationary axle during the retraction period, and said squeegie means includes a bracket disposed on an outer face of said housing having a radially outwardly extending wiper, a further wiper depending from said first wiper and biased thereto, the hose extending therebetween, whereby said biasing allows the squeegie to operate in the absence of water pressure.

2. A hose reel assembly comprising in combination:

a housing having an interior adapted to receive therein a plurality of hose wraps looped over a central supporting drum, inlet means to provide fluid communication between a source of water and the hose disposed thereon, a hose outlet extending through an opening within the housing, squeegie means sensitive to fluidic pressure of the water system whereby in the absence of fluidic pressure said squeegie means is enabled so that when the hose is retracted back into said housing water is purged from the hose, said squeegie means being assisted in purging by means of a spring biasing between said hose supporting drum and a stationary axle during the retraction period, said drum spring being resisted by a selectively engageable pawl carried on said drum and ratchet means on said axle, said hose inlet communicating with the hose disposed upon said drum by means of a transfer hose having a swivel and threaded outlet communicating with the hose inlet and a radially extending passageway communicating with a longitudinally extending portion underlying the wrapped hose and overlying a drum supporting surface, whereby rotation of said drum does not twist the hose, said drum including a hose support surface connected to a rotating axle, said hose supporting surface including hose support sidewalls extending upwardly therefrom, a passageway extending between said hose support sidewalls and said hose support surface for admission therein of said transfer hose, and a further web extending between said hose support surface and said stationary axle separated from said stationary axle by a bearing, said stationary axle being formed integrally with said housing, said rotating axle carried on said stationary axle by means of a bearing, said housing formed from first and second sidewalls of substantially circular configuration having a hose feed side and a ratchet side and an annular end wall circumscribing the outer periphery of said sidewalls, said ratchet means including a spring connected between said web and a pivot post on said web, said pivot post including a pawl overlying said pivot post having an end communicating with gear teeth disposed on a ratchet gear, said ratchet gear carried on said stationary axle and fixed thereto, whereby rotation of said web indexes said pawl against said teeth, said ratchet wheel including a void area on an outer periphery thereof defining absence of teeth to allow release of said pawl and ratchet assembly, wherein said squeegie means includes a bracket disposed on an outer face of said housing having a radially outwardly extending wiper, a further wiper depending from said first wiper and biased thereto, the hose extending therebetween whereby said biasing allows the squeegie to operate in the absence of water pressure.

3. A hose reel assembly comprising in combination:

a housing having an interior within which a hose drum is carried, a centrally disposed stationary shaft integrally formed with said housing communicating with a coaxial rotating axle through a bearing, said housing communicating with said rotating axle through a bearing, said rotating axle carrying said hose drum thereon through a web means, said rotating axle and stationary axle coaxially related defining a split axle to allow relative rotation of said drum relative to said housing, a water inlet axially disposed communicating with hose disposed on said drum and an outlet through said housing allowing another end of the hose to pass therethrough whereby hose can be paid in and out of said housing interior and on said drum, a squeegie mechanism disposed overlying the outlet opening and straddling the hose, said squeegie mechanism provided with biasing means overriden by fluidic pressure, and wherein said squeegie means includes a U-shaped bracket having an outwardly extending overlying wiper and a depending wiper of substantially L-shaped configuration straddling the outlet portion of the hose, and biasing means extending therebetween conditioned by water pressure.

4. A hose reel assembly comprising in combination:

a housing having an interior within which a hose drum is carried, a centrally disposed stationary shaft integrally formed with said housing communicating with a coaxial rotating axle through a bearing, said housing communicating with said rotating axle through a bearing, said rotating axle carrying said hose drum thereon through a web means, said rotating axle and stationary axle coaxially related and defining a split axle to allow relative rotation of said drum relative to said housing, a water inlet axially disposed communicating with hose disposed on said drum and an outlet through said housing allowing another end of the hose to pass therethrough, whereby hose can be paid in and out of said housing interior and on said drum, said drum operating against a spring extending between a hose supporting surface and said stationary axle, ratchet means opposing rotation of said spring, whereby indexing of said drum can be afforded, wherein said assembly includes a squeegie mechanism disposed overlying the outlet opening and straddling the hose, said squeegie mechanism provided with biasing means overriden by fluidic pressure.

said ratchet means including a pawl carried on and rotating with said drum, a ratchet gear fixed on said stationary axle, said pawl biased with a spring extending between said pawl and said rotating drum, a portion of said ratchet teeth interrupted on an outer periphery of said ratchet wheel to allow selective disabling of said pawl and ratchet for rewinding and allowing said drum spring to work, wherein said squeegie means includes a U-shaped bracket having an outwardly extending overlying wiper and a depending wiper of substantially L-shaped configuration straddling the outlet portion of the hose, and biasing means extending therebetween conditioned by water pressure.

5. The device of claim 4 including a carry handle carried on an outer periphery of said housing, said housing formed from said first and second sidewalls of substantially circular configuration and an annular arcuate end wall circumscribing said sidewalls.

6. A hose reel assembly including a hose inlet axially oriented with an axis of rotation of a drum disposed within an overlying housing, a radially extending hose communicating from the inlet hose to a supporting surface for the hose on the drum, a longitudinally extending transfer hose segment underlying the hose wrapped on said drum, whereby admission of water through said hose inlet extends through the transfer hose and thereafter to the wrapped hose on the drum, an outlet portion of the hose extending without the housing, wherein said transfer hose passes through a hole in said drum, wherein said drum is carried on a rotating axle, said rotating axle connected to a stationary axle through a bearing, said drum including a hose supporting surface and upwardly extending hose support sidewalls, first and second webs extending downwardly towards said axle, one of said webs fixed to said rotating axle, another of said webs overlying said stationary axle through a bearing surface, and squeegie means disposed on said outer endwall, including a bracket having an outwardly extending overlying wiper, a depending wiper staraddling the outlet hose and biasing means to override fluidic pressure from the water source.

* * * * *